United States Patent [19]

Clifton et al.

[11] Patent Number: 4,691,531

[45] Date of Patent: Sep. 8, 1987

[54] CENTRAL AIR CONDITIONING SYSTEM

[75] Inventors: Kevin Clifton, P.O. Box 13175, Kanata, Ontario, Canada, K2K 1X4; Sean Delaney, Kanata, Canada

[73] Assignee: Kevin Clifton, Kanata, Canada

[21] Appl. No.: 882,293

[22] Filed: Jul. 7, 1986

[30] Foreign Application Priority Data

Mar. 26, 1986 [CA] Canada ..... 505252

[51] Int. Cl.[4] ..... T25D 23/12

[52] U.S. Cl. ..... 62/263; 62/297; 62/298

[58] Field of Search ..... 62/298, 302, 263, 297

[56] References Cited

U.S. PATENT DOCUMENTS

| | | | |
|---|---|---|---|
| 2,496,720 | 2/1950 | Heiman | 417/363 |
| 2,560,467 | 7/1951 | Moore | 62/297 X |
| 2,719,410 | 10/1955 | Deering | 62/302 X |
| 2,905,454 | 9/1959 | Wood | 62/302 X |
| 3,123,987 | 3/1964 | Moore | 62/263 |
| 3,220,711 | 11/1965 | Leppard et al. | 62/263 X |
| 3,252,508 | 5/1966 | Goetll | 165/48 |
| 3,712,078 | 1/1973 | Maynard et al. | 62/298 X |
| 4,121,562 | 10/1978 | Grott | 126/85 B |
| 4,457,140 | 7/1984 | Rastelli | 62/298 X |

FOREIGN PATENT DOCUMENTS

| | | | |
|---|---|---|---|
| 813593 | 5/1969 | Canada | 62/46 |
| 817074 | 7/1969 | Canada | 45/5 |
| 1162065 | 2/1984 | Canada | 62/46 |

*Primary Examiner*—William E. Tapolcai

*Attorney, Agent, or Firm*—Pascal & Associates

[57] ABSTRACT

A water cooled central air conditioning system for use in combination with the existing duct work and furnace of a central air heating system of the type commonly used for heating residential homes. The air conditioning system is comprised of an A-frame evaporator coil supported on angle irons which are integral with an abutting box-line central unit housing a compressor, condensor, expansion valve, water inlet, outlet, condensate outlet, and other components. The entire monolithic assembly is suspended from above by spring-loaded cords attached to the central unit. The evaporator coil projects through an opening in the furnace wall into the hot air plenum of the furnace, and a foam gasket provides a resilient air-tight seal around the opening.

15 Claims, 6 Drawing Figures

CENTRAL AIR CONDITIONING SYSTEM

Figure 1:
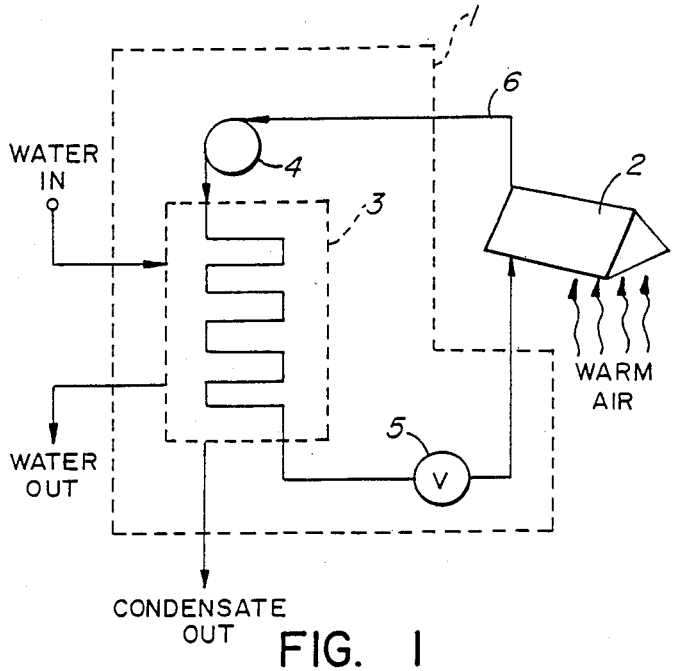

This invention relates in general to air conditioning systems and more particularly to a monolithic water cooled central air conditioning system for use in combination with the existing duct work and furnace of a central air heating system.

Central air conditioning systems are well known, and are typically comprised of a compressor and two heat exchangers. A gaseous refrigerant is compressed by the compressor to a high pressure superheated gas. The superheated refrigerant flows into the first heat exchanger, known as the condensor. Within the condensor, cold water passes over the tubing that carries the superheated refrigerant and removes heat therefrom. The refrigerant leaves the condensor as a saturated liquid under high pressure. It flows through an expansion valve, which reduces the pressure, and then flows to the evaporator, the second heat exchanger. A fan forces warm air over the evaporator tubes and the refrigerant expands, removing heat from the air. The refrigerant leaves the evaporator as a saturated gas under low pressure, flows back into the compressor, and the cycle is repeated.

Water cooled air conditioning systems have been designed for supplementing existing central air heating systems found typically in residential homes. Such systems utilize the existing duct work and furnace for providing forced distribution of air over an evaporator coil disposed in the hot air plenum of the furnace.

According to such prior art add-on air conditioning system the central unit which houses the condensor, compressor and ancillary components, was separated a considerable distance from the evaporator coil. In particular, the coil was typically suspended from within the furnace hot air plenum and connected by lengthy tubing to the central unit, which typically rested on the floor or on a stand.

U.S. Pat. No. 4,134,448 of Luksus, issued Jan. 16th, 1979, discloses such a prior art add-on air conditioning system wherein the central unit is separate from the evaporator coil, and rests on the floor adjacent the furnace. The evaporator coil is housed within the furnace hot air plenum and connected via conduits or tubing for carrying the refrigerant, to the central unit resting on the floor.

Installation of such prior art add-on air conditioning systems typically required the services of a qualified technician to mount the evaporator coil within the hot air plenum and extend the necessary tubing between the central unit and coil. This typically involved sheet metal work and welding to extend the interconnecting tubing through the furnace wall. Also, in order to remove the central unit in the event of servicing, the interconnecting tubing was required to be disconnected between the central unit and coil, resulting in loss of pressure charge of the refrigerant within the tubing and drainage of the refrigerant.

According to the present invention, an add-on central air conditioning system is provided for installation within the existing duct work and furnace of a central air heating system of the type commonly used for heating residential homes. The air conditioning system is comprised of an evaporator coil heat exchanger supported on angle irons which are integral with an abutting box-line central unit, the entire monolithic assembly being supported via, for example, spring-loaded cords attached to the central unit housing. The coil projects through an opening or aperture in the furnace wall into the hot air plenum of the furnace, and a foam gasket provides a resilient air-tight seal around the opening.

As a result of the evaporator coil being supported by the central unit from outside the furnace wall, installation and servicing of the air conditioning system of the present invention is straightforward since the coil unit and central unit are installed and removed simultaneously, as a monolithic assembly. Consequently, the time required for installation is reduced and the prior art disadvantage of requiring the services of a skilled technician is overcome. Also, the prior art problem of lost refrigerant pressure charge is overcome since the central unit and coil are not disconnected from one another upon removal from the furnace.

Whereas prior art add-on systems required large quantities of refrigerant extending from the central unit to the evaporator coil via the extensive tubing, according to the present invention the central unit and coil are in close proximity to one another such that very little interconnecting tubing, and consequently less refrigerant is required that in prior art systems. The decreased tubing results, as well, in greater operating efficiency than in prior art add-on systems.

The air conditioning system of the present invention can be realized in the form of a kit, comprised of the aforementioned monolithic central unit and evaporator coil, a template for use as a guide in cutting the opening or aperture in the furnace wall, and apparatus for supporting the monolithic assembly, such as spring-loaded cords for suspending the central unit from the ceiling, outside of the furnace.

Installation of the air conditioning system of the present invention comprises the straightforward steps of cutting the aforementioned opening or aperture in the furnace wall using the provided template, positioning the integral central unit and evaporator coil, such that the coil extends through the aperture in the furnace wall, and supporting the entire monolithic assembly from outside the furnace wall by means of, for example suspending the central unit from above via cords, or alternatively supporting the central unit on a stand.

Figure 2:
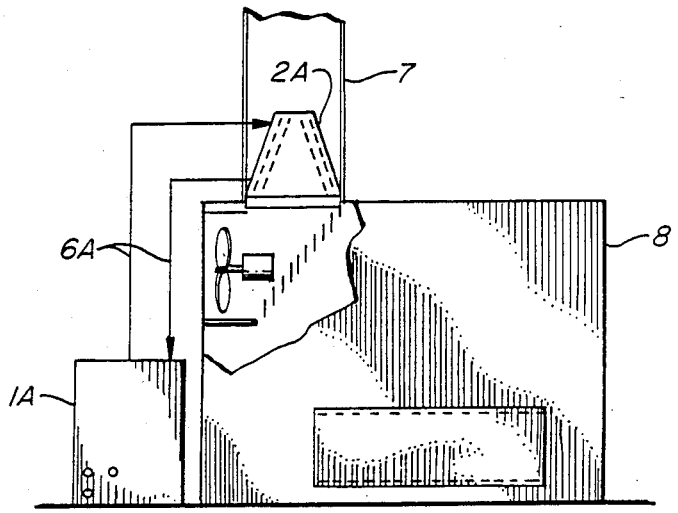
FIG. 2 (PRIOR ART)
Figure 3:
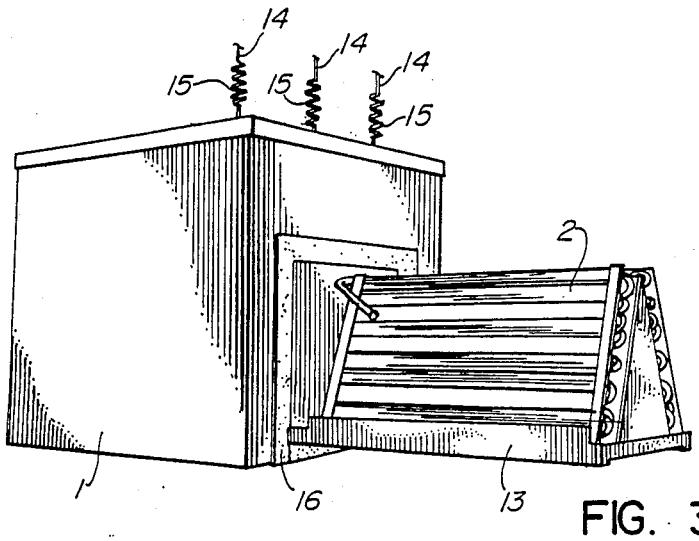
Figure 4:
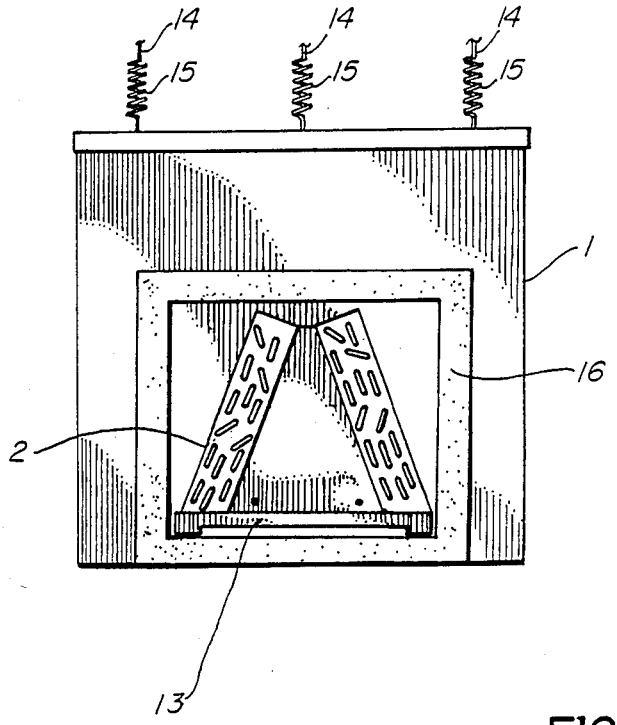
Figure 5:
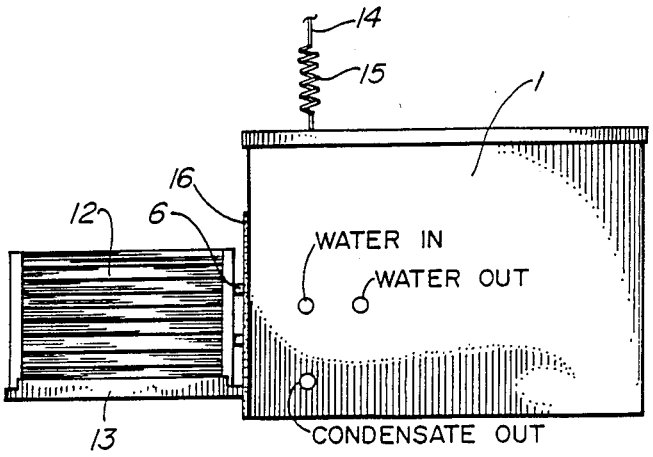
Figure 6:
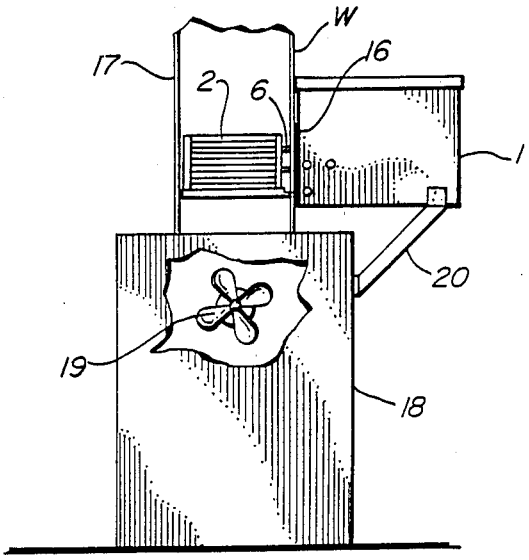

A better understanding of the invention will be obtained with reference to the detailed description below in conjunction with the following drawings, in which:

FIG. 1 is a schematic diagram of a well known water cooled air conditioning system, FIG. 2 is a side elevation showing the combination of a hot air furnace and an add-on central air conditioning system according to the prior art, FIG. 3 is a perspective view of an air conditioning system according to a preferred embodiment of the present invention, FIG. 4 is a front elevation of the air conditioning system shown in FIG. 3, FIG. 5 is a right side view of the air conditioning system shown in FIGS. 3 and 4, and FIG. 6 is a front elevation showing the combination of a hot air furnace and central air conditioning system according to an alternative embodiment of the present invention.

With reference to FIG. 1, a central unit 1 is shown connected to an evaporator coil 2, the central unit being comprised of a condensor 3, compressor 4 and expansion valve 5, each of the components of the air conditioning system being interconnected via tubing 6, according to well known design. In addition to the condensor 3, compressor 4 and expansion valve 5, additional ancillary components are also typically housed within the central unit 1, such as relays, pressure switches, etc.

A water inlet and water outlet are connected to the unit 1 for supplying cooling water to the condensor 3, according to well known techniques, and a condensate drain is provided for draining off condensation which develops on the surface of the condensor 3.

As discussed above, according to prior art add-on central air conditioning systems, tubing 6 for interconnecting the central unit 1 and evaporator coil 2 was typically very extensive since the central unit and coil were usually separate, the central unit 1 resting on the floor or on a stand, and the evaporator coil 2 being suspended from or mounted within the hot air plenum of the furnace.

With reference to FIG. 2, a prior art add-on central air conditioning system is shown for connection to a hot air plenum 7 of a furnace 8. Such a system is described for example in the aforementioned U.S. patent of Luksus.

A central unit 1 is disposed on the floor adjacent to the furnace 8, and extensive tubing 6 extends from the central unit to an evaporator coil unit 2 disposed within the hot air plenum 7. The evaporator coil 2 is mounted within plenum 7 via suitable mounting apparatus such as crossbar braces or suspension cords. A fan 9 of the furnance 8 blows hot air through the evaporator coil 2 which acts as a heat exchanger for cooling the air as discussed above according to well known principles of air conditioning.

The prior art system of FIG. 2 suffers from the above mentioned disadvantage of requiring professional installation and servicing since the central unit 1 and evaporator coil 2 are separate units to which interconnecting tubing 6 must be welded. Extension of the tubing 6 through the walls of plenum 7 typically requires sheet metal work. Also, in the event that the prior art system is disassembled for servicing, pressure charge in the tubing 6 is lost and the refrigerant must be drained and subsequently replaced.

With reference to FIGS. 3, 4 and 5, an add-on water cooled central air conditioning system is shown according to the present invention comprised of a central unit 1 and an evaporator coil 2, in the form of an A-frame structure connected in close proximity to the central unit 1 and supported by a pair of angle irons 13 for insertion through an aperture in the furnace wall, as discussed in greater detail below with reference to FIG. 6.

According to the preferred embodiment, a series of cords 14 are connected through vibration absorbing springs 15 to the central unit 1, for suspending the unit 1 from above, such as from the ceiling of a residential home or from water pipes running across the ceiling. A foam sealing gasket 16 is attached to the central unit 1 for effecting an air-tight seal around the aperture in the furnace wall or hot air plenum. According to the preferred embodiment, gasket 16 was an approximately 1 inch thick foam sealing gasket.

With reference to FIG. 6, an alternative embodiment of the air conditioning system of the present invention is shown in combination with the hot air plenum 7 of a furnace 8. The evaporator coil 2 extends through the side wall of the hot air plenum 7 and is connected via a very small amount of tubing 6 to the adjacent central unit 1 through an aperture cut in the plenum wall. Gasket 16 provides an air-tight seal around the aperture between the wall and central unit 1.

According to the alternative embodiment illustrated, the cords 14 and associated springs 15 for suspending the monolithic assembly, as discussed with references to FIGS. 3, 4 and 5, are replaced by a support brace 20 connected to the wall of furnace 8 for supporting the monolithic assembly from underneath the central unit 1.

In order to install the air conditioning system of the present invention, with reference to FIG. 6, a square template (not shown) is provided for use as a guide in cutting the aforementioned opening or aperture in the wall of plenum 7. Next, the brace 20 is screwed into the side wall of the furnace 8 and the entire monolithic assembly is mounted on the brace 20 for supporting the undersurface of the central unit 1, evaporator coil 2 is inserted through the aperture in the plenum wall. The gasket 16 forms an air-tight seal around the aperture, between the central unit, and the plenum wall.

However, according to the preferred embodiment illustrated in FIGS. 3, 4 and 5, the air conditioning system was mounted utilizing the aforementioned springs 15 and cords 14, since the use of the vibration absorbing suspension cords results in substantial reduction of vibration noise in comparison with mounting the assembly via the support brace 20.

Finally, water inlet and outlet, and condensate outlet hoses are connected to the central unit 1, and a source of power such as 230 volts, one phase at 60 Hz, is applied to the central unit 1.

In summary, the air conditioning system of the present invention can be easily installed without requiring the services of a skilled technician, and easily removed for servicing. The entire assembly is preferably mounted or suspended at approximately shoulder level such that all components of the central unit 1, such as the compressor 4, and condensor 3 can be serviced easily without stooping or bending. Whereas prior art air conditioning systems required sheet metal work to cover holes drilled in the furnace wall for passing the interconnecting refrigeration tubing 6A (FIG. 5), according to the present invention, the central unit 1 in combination with the gasket 16, provides an effective seal around the aperture in the plenum wall such that no sheet metal work or expensive tube welding is required.

In addition, because the central unit 1 is integral with the plenum wall, prior art extensive tubing is eliminated. Consequently, less refrigerant and pressure charging is required according to the present invention in comparison with prior art add-on air conditioning systems. The relatively short length of tubing extending between the evaporator coil and central unit also contributes to higher efficiency over prior art systems.

A person understanding the present invention may conceive of other embodiments or modifications thereof. For example, while the gasket 16 was discussed above as being integral with the central unit 1, it may alternatively be provided as a separate piece. Also, as discussed above, a stand or support brace or rods can be utilized to support the central unit 1 from beneath in lieu of the cords 14 and springs 15 of the preferred embodiment.

All such modifications and further embodiments are believed to be within the sphere and scope of the present invention as defined in the claims appended hereto.

We claim:

1. An air conditioning system for use in conjunction with a hot air plenum of a residential furnace, comprised of a central unit housing vibration causing components, an evaporator coil, vibration absorbing means for supporting said central unit adjacent said hot air plenum, means integral with and projecting from said central unit through an aperture in said hot air plenum for supporting said coil in said hot air plenum, and resilient means connected to said central unit for effecting a seal around said aperture between said hot air plenum and said central unit.

2. An air conditioning system as defined in claim 1, wherein said means for supporting said coil in said hot air plenum are comprised of angle irons projecting from said central unit.

3. An air conditioning system as defined in claim 2, wherein said means for effecting a seal is comprised of a gasket mounted on said central unit around the aperture in said hot air plenum.

4. An air conditioning system as defined in claim 3, wherein said vibration absorbing means is adapted for supporting said central unit and said evaporator coil from outside said hot air plenum.

5. An air conditioning system as defined in claim 3, wherein said vibration absorbing means is adapted for suspending said central unit from above such that said evaporator coil is suspended at a predetermined height within said hot air plenum.

6. An air conditioning system as defined in claim 3, wherein said vibration absorbing means is comprised of a plurality of cords connected through vibration absorbing springs to the central unit for suspending said central unit and evaporator coil from outside the hot air plenum, such that said evaporator coil is suspended at a predetermined height within said hot air plenum.

7. An air conditioning system as defined in claim 3, wherein said vibration absorbing means is comprised of a multiplicity of spring-loaded cords attached to the central unit, for suspending the central unit and evaporator coil from above.

8. An air conditioning system as defined in claim 3, wherein said central unit further includes a compressor, condensor, expansion valve, water inlet, water outlet and condensate outlet.

9. An air conditioning system as defined in claim 3, wherein said gasket is fabricated from foam.

10. An air conditioning system as defined in claim 3, wherein said central unit is housed in an insulated compartment.

11. An air conditioning system as defined in claim 3, wherein said evaporator coil is comprised of an A-frame structure for housing refrigerant tubing connected to said central unit.

12. An air conditioning system as defined in claim 3, wherein said central unit is comprised of a box-line insulated housing.

13. An air conditioning system as defined in claim 3, wherein said angle irons are welded to said central unit.

14. An air conditioning system as defined in claim 3, wherein said vibration absorbing means is adapted for supporting said central unit and evaporator coil from a furnace wall beneath the central unit and hot air plenum.

15. An air conditioning system as defined in claim 3, wherein said vibration absorbing means is comprised of one or more support braces for supporting said central unit and evaporator coil from a furnace wall beneath the central unit and hot air plenum.

* * * * *